US005639229A

United States Patent [19]

Cooke

[11] Patent Number: 5,639,229

[45] Date of Patent: Jun. 17, 1997

[54] FUEL INJECTION PUMP HAVING A TWO PISTON SPILL VALVE ARRANGEMENT

[75] Inventor: Michael Peter Cooke, Gillingham, England

[73] Assignee: Lucas Industries, Solihull, England

[21] Appl. No.: 563,467

[22] Filed: Nov. 28, 1995

[30] Foreign Application Priority Data

Nov. 29, 1994 [GB] United Kingdom ..... 9424021

[51] Int. Cl.[6] ..... F02M 41/14

[52] U.S. Cl. ..... 417/440; 123/506

[58] Field of Search ..... 417/439, 440, 417/462; 123/450, 506

[56] References Cited

U.S. PATENT DOCUMENTS

| | | | |
|---|---|---|---|
| 4,874,301 | 10/1989 | Greeves et al. | 417/462 |
| 5,119,786 | 6/1992 | Collingborn et al. | 123/450 |
| 5,207,202 | 5/1993 | Collingborn et al. | 123/450 |
| 5,413,081 | 5/1995 | Collingborn | 123/506 |
| 5,478,213 | 12/1995 | Harris et al. | 417/440 |
| 5,546,906 | 8/1996 | Cooke | 123/450 |

FOREIGN PATENT DOCUMENTS

| | | | |
|---|---|---|---|
| 2275741 | 9/1994 | European Pat. Off. | 123/450 |
| 2253445 | 9/1992 | United Kingdom . | |
| 9306361 | 4/1993 | WIPO . | |

*Primary Examiner*—Timothy Thorpe
*Assistant Examiner*—Roland G. McAndrews, Jr.
*Attorney, Agent, or Firm*—Dvorak and Traub

[57] ABSTRACT

A fuel pumping apparatus comprises a pumping plunger reciprocable in a bore to supply fuel to the cylinders of an associated engine. A spill valve arrangement is provided to control fuel delivery, the spill valve arrangement including a valve member coupled to a first piston which is slidable within a first cylinder. Passage means are provided in the first piston interconnecting the ends of the first cylinder permitting restricted flow therebetween. A second piston slidable within a second cylinder is arranged to engage an end of the first piston, a spring biasing the second piston towards the first piston and biasing the valve member into engagement with a valve seat. In use, at high engine speed the pressure of fuel between the pistons increases, separating the pistons permitting fuel to escape through a passage provided in the second piston. Such an escape of fuel results in additional fresh, cool, fuel being drawn into the pumping apparatus thus cooling the pumping apparatus.

8 Claims, 1 Drawing Sheet

FUEL INJECTION PUMP HAVING A TWO PISTON SPILL VALVE ARRANGEMENT

BACKGROUND OF THE INVENTION

1. Field of the Invention

This invention relates to a fuel injection pumping apparatus for supplying fuel to a compression ignition engine and of the kind comprising a cam actuated pumping plunger housed within a bore, means for supplying fuel to the bore, an outlet from the bore and through which fuel can flow to an associated engine and a spill valve operable to allow fuel to spill from the bore thereby to control the quantity of fuel supplied through said outlet, said spill valve including a valve member coupled to a piston which is slidable within a cylinder, resilient means acting on the piston to bias the valve member into engagement with a seating defined about a spill passage which opens into an end of the cylinder and valve means operable to supply fluid under pressure to said one end of the cylinder to lift the valve member from the seating.

2. Description of the Prior Art

An example of such an apparatus is seen in GB-A-2253445. In such an apparatus neglecting leakage, all the fuel which is spilled from the bore flows into the one end of the cylinder to displace the piston against the action of the resilient means. The spilled fuel is returned to the bore which is then supplied with further fuel from a source to displace the plunger outwardly its maximum extent.

The bore is formed in a distributor member part of which is rotatably mounted in a body part of the apparatus, there being a very close working clearance therebetween. The aforesaid outlet is in the form of a passage which extends within said part of the distributor member and in the operation of the apparatus the fuel becomes heated and heat is transmitted to the distributor member which as a result expands and causes a reduction in the working clearance. This reduction in the working clearance leads to the possibility of seizure and there is a particular risk at high speeds due to the increased fuel pressure.

SUMMARY OF THE INVENTION

The object of the present invention is to provide an apparatus of the kind specified in an improved form.

According to the invention an apparatus of the kind specified comprises a further piston housed in a further cylinder, the further piston having a smaller diameter than the first mentioned piston and being interposed between the resilient means and the first mentioned piston, the presented end surfaces of said pistons being shaped so that a portion of said surface of the further piston is exposed to the pressure in the other end of the first mentioned cylinder, passage means interconnecting the ends of said first mentioned cylinder and valve means operable when in use the pressure in said other end of the first mentioned cylinder is sufficient to cause separation of the presented surfaces of the pistons, to allow fuel to escape from said other end of the first mentioned cylinder.

BRIEF DESCRIPTION OF THE DRAWINGS

An example of an apparatus in accordance with the invention will now be described with reference to the accompanying drawings in which.

DETAILED DESCRIPTION OF THE INVENTION

Figure 1:
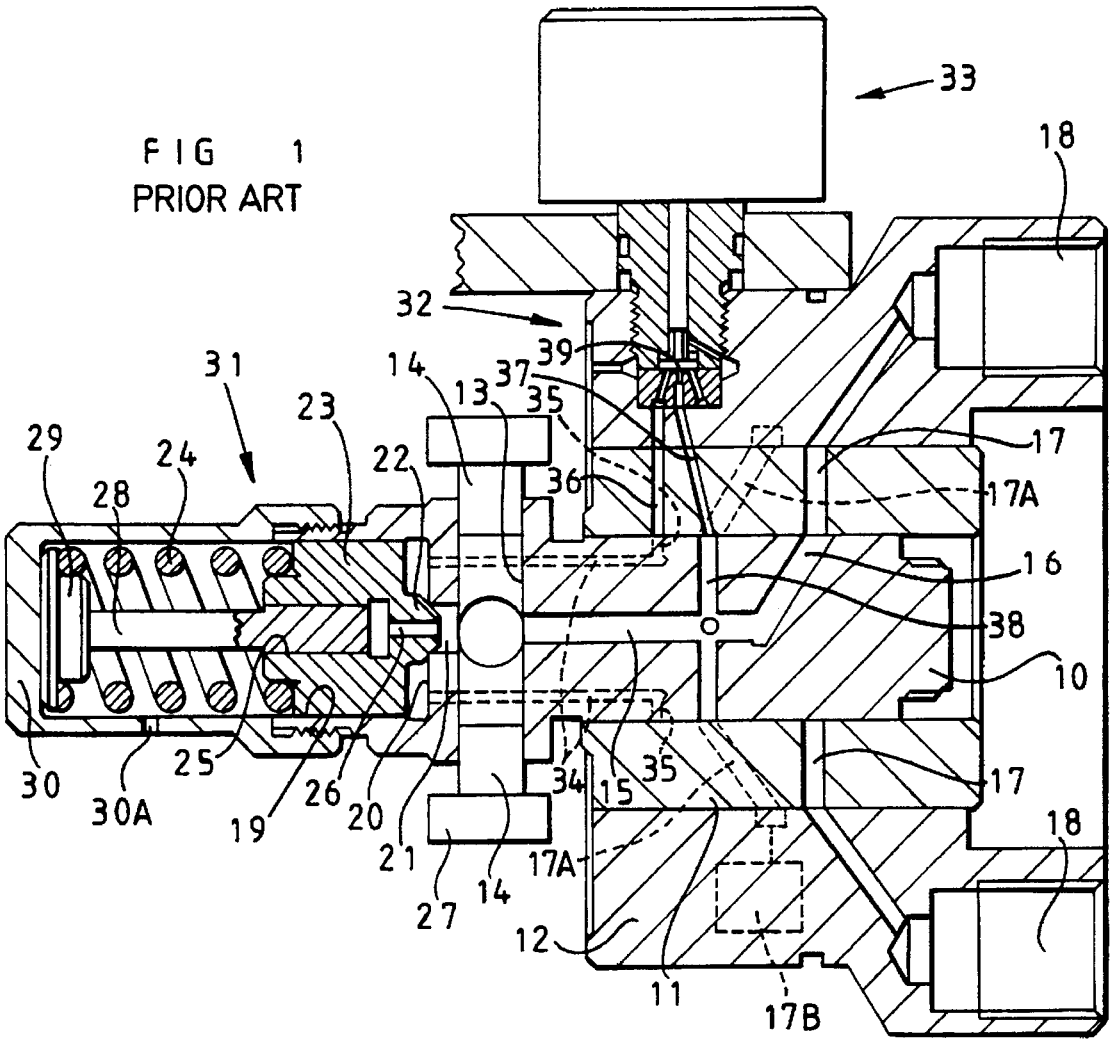
FIG 1 PRIOR ART
FIG. 1 is a sectional side elevation of a known form of the apparatus.

Referring to FIG. 1 of the drawings the apparatus comprises a rotary distributor member 10 which is journaled in a fixed sleeve 11 forming part of a body part 12. The distributor member in use, is driven in timed relationship with the associated engine by means of a drive shaft (not shown). A portion of the distributor member extends from the sleeve and there is formed therein a transverse bore 13 in which is mounted a pair of pumping plungers 14. In the particular example, which shows a pump for supplying fuel to a four cylinder engine, a further transverse bore is provided and a further pair of plungers are located therein in order to increase the pumping capacity of the apparatus. The bores are disposed at right angles to each other and the inner portions of the bores communicate with a longitudinal passage 15 extending within the distributor member and communicating with an outwardly extending delivery passage 16.

The plungers 14 are arranged to be moved inwardly by the action of cam lobes formed on the internal peripheral surface of a cam ring 27 which surrounds the distributor member and during the inward movement of the plungers 14, the delivery passage 16 registers with one of a plurality of outlet ports 17 which communicate with outlets 18 in the body, the outlets 18 in use being connected to the injection nozzles of the associated engine.

Also provided in the body are a plurality of inlet ports 17A which communicate with a source of fuel under pressure, conveniently the outlet of a vane pump 17B the rotary part of which is coupled to the distributor member. The inlet ports 17A are positioned to register in turn with inlet passages 38 formed in the distributor member and communicating with the passage 15. In use, during the whole time the plungers are moved inwardly, the delivery passage 16 is in register with an outlet port 17 and fuel can be supplied to the associated engine. As the distributor member rotates, the delivery passage 16 moves out of register with an outlet port 17 and the inlet passages move into register with the inlet ports so that fuel can now flow to the bores 13 to urge the plungers outwardly by an amount which is determined by the base circle of the cam ring or by stop plates not shown, it being appreciated that normally cam followers including rollers, will be interposed between the plungers 14 and the cam lobes.

Formed in the distributor member is a cylinder 19 having at one end an end wall 20 in which is formed a spill passage 21 which communicates with the bores 13. Surrounding the spill passage is a seating which is engaged by a valve member 22 extending from an end face of a piston 23 which is slidable within the cylinder. The piston 23 is biased so that the valve member engages with the seating, by means of a coiled compression spring 24. Formed in the piston is an axially disposed blind drilling 25 which extends towards said end face of the piston and the inner end of the drilling communicates by way of a passage 26 formed in the valve member 22, with the bores 13. Slidable within the drilling 25 is a plug which is carried on a stem 28 having an end portion 29 formed as a spring abutment. The spring 24 engages the abutment 29 and maintains the abutment in contact with the end wall 30 of a cap 31 which is in screw thread engagement with the extended portion of the distributor member. An opening 30A is formed in the cap 31 and places the interior of the cap in communication with the interior of the housing of the apparatus.

The end area of the plug is substantially equal to the area embraced by the line of contact between the seating and the valve member 22 so that the piston is substantially pressure balanced and will be maintained in the position shown in which the valve member is in engagement with the seating, by the force exerted by the spring 24. In order in use, to effect movement of the piston 23 against the action of the spring and thereby to lift the valve member 22 from the seating so as to permit further fuel displaced by the plungers to flow into one end of the cylinder, fuel under pressure is admitted to the one end of the cylinder so that the pressure acting on the end face of the piston will move the piston against the action of the spring. The flow of fuel into the annular space is conveniently controlled by valve means in the form of a control valve generally indicated at 32 and which itself is controlled by an electro-magnetic actuator 33. Supply of electric current to the actuator is under the control of an electronic control system not shown.

Extending from the one end of the cylinder 19 are in the particular example, four axially disposed passages 34 which have radially disposed portions 35 opening onto the periphery of the distributor member at positions so that they can register with a first connecting port 36 formed in the body part and sleeve. Also formed in the body part and sleeve is a second connecting port 37 which extends from the periphery of the distributor member and the two connecting ports can be placed in communication with each other by the valve 32. The connecting port 37 is positioned to register with the inlet passages 38 formed in the distributor member. Within the valve 32, the connecting port 37 is closed by a valve member 39 when the actuator is energized and the pressure of fuel within the connecting port 37 lifts the valve member 39 from its seating to permit flow of fuel into the connecting port 36 and through one of the passages 34 into the annular space when the actuator is de-energized. As previously stated the flow of electric current to the actuator 33 is controlled by an electronic control system and the actuator is arranged to be de-energized when a pre-determined inward movement of the pumping plungers has taken place. When the actuator is de-energized fuel at high pressure is supplied to the one end of the cylinder 19 and acts upon the end face of the piston to move the piston against the action of the spring 24. The initial movement lifts the valve member 22 from the seating and substantially unrestricted flow of fuel can then take place into the cylinder by way of the port 21. This flow of fuel results in a reduction in the pressure of fuel and termination of the flow of fuel to the associated engine.

When the crests of the cam lobes are reached the plungers are allowed to move outwardly and the spring 24 urges the piston towards the position in which it is shown. This movement results in displacement of the fuel spilled into the aforesaid space back into the bores 13 to effect outward movement of the plungers. Such fuel as is lost by leakage together with the fuel delivered to the associated engine, is made up by a flow of fuel from the fuel supply pump 17B by way of the inlet ports and passages. In order to ensure that the movement of the piston 23 under the action of the spring 24 is not hindered as the valve member approaches the seating, a leakage path may be provided from the annular space. The leakage path is provided by a restricted drilling or it can be formed by ensuring that leakage of fuel can take place along the working clearance defined between the piston and the cylinder in which it is located. In the example the ports 36 and 37 are isolated from the passages 35 and 38 except during the inward movement of the plungers. However, if desired the connections need not be ported so that by maintaining the valve 32 in the open position whilst the piston 23 is returning to the position shown, there will be no need for the aforesaid restricted passage or clearance.

Figure 2:
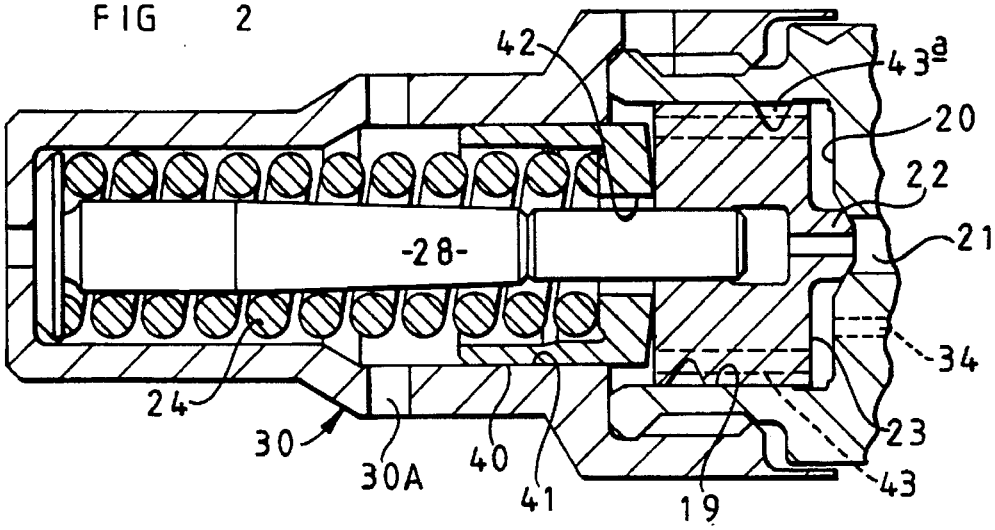
FIG. 2 is a sectional side elevation showing the modification in accordance with the invention.

In accordance with the invention a portion of the apparatus as shown in FIG. 1 is modified as shown in FIG. 2 in which identical reference numerals are used where possible to those of FIG. 1. The apparatus is modified by the provision of a further piston 40 which is housed within a further cylinder 41 coaxial with the cylinder 19 but of smaller diameter. The further piston 40 is of cup shaped form and in the base wall there is formed an opening 42 through which extends with clearance, the stem and plug 28 in this case formed in two parts. The spring 24 engages the inner surface of the base wall of the piston 40 to urge the presented faces of the two pistons into engagement and as with the example of FIG. 1 to urge the valve member into engagement with the seating.

One of the presented faces of one of the pistons in this case the piston 40, inclines away from the presented face of the other piston so as to al low access for fuel under pressure in the end of the cylinder 19 remote from the end face 20. The two pistons at the region of engagement form an annular fuel tight seal to prevent escape of fuel from the adjacent end of the cylinder into the opening 42. Moreover, the opposite ends of the cylinder 19 communicate with each other by way of passages 43 formed in the piston 23 or alternatively by way of a longer, helical passage 43A formed in the cylindrical surface of the piston 23 or alternatively by way of passages in the surrounding body.

In operation, at low engine speeds the modified apparatus operates as described with the two pistons moving together to store the spilled fuel which is returned to the bores 13 as the plungers are allowed to move outwardly. During movement of the pistons against the action of the spring fuel will flow along the passages 43, 43A towards the one end of the cylinder 19 and when the pistons under the action of the spring move in the opposite direction, the flow of fuel in the passages will be in the reverse direction. As the engine speed increases the rate at which fuel must flow along the passages towards the one end of the cylinder also increases because the pumping rate of the plungers increases with speed. The passages 43, 43A offer a restriction to the flow of fuel and as a result the fuel pressure acting on the presented faces of the two pistons increases. When the fuel pressure acting on the annular area of the end face of the piston 40 generates a force equal to the force exerted by the spring 24, the pistons separate with the practical effect that fuel flows into the opening 42 and escapes by way of the openings 30A into the interior of the housing of the apparatus. As a result of fuel escaping through the opening 42, more fresh and cooler fuel has to be supplied to the bores 13 from the pump 17B. The fuel temperature within the bores 13 and the passages in the distributor member is therefore controlled so that the distributor member itself is not heated to the same extent by the fuel as in the example of FIG. 1. The flow of fuel through the opening 42 increases with engine speed and is also influenced by the degree of restriction offered by the passages 43. The helical passage 43A formed in the cylindrical surface of the piston 23 being longer, offers a greater restriction to flow and hence more fuel will flow through the opening 42. This effect is increased at higher speeds, the resistance to flow of fuel through the passage 43A being relatively low at low engine speeds.

If a minimum volume of fuel is required to be lost through the opening, the extent of movement of the piston 23 can be limited by causing it to engage with the end of its cylinder. At low speeds therefore the piston 40 will merely act as a relief valve and will separate from the piston 23 to allow fuel to flow into the opening 42. At increased engine speeds the two pistons may separate before the movement of the piston 23 is halted by the stop.

What is claimed is:

1. A fuel pumping apparatus comprising a cam actuated pumping plunger housed within a bore, means for supplying fuel to the bore, an outlet from the bore through which fuel can flow to an associated engine and a spill valve operable to allow fuel to spill from the bore thereby to control the quantity of fuel supplied through said outlet, said spill valve including a valve member coupled to a first piston which is slidable within a first cylinder having a first end and a second end, resilient means acting on the first piston to bias the valve member into engagement with a seating defined about a spill passage which opens into the first end of the first cylinder and valve means operable to supply fluid under pressure to said first end of the first cylinder to lift the valve member from the seating, and characterized by a second piston slidable in a second cylinder, the second piston having a smaller diameter than the first piston and being interposed between the resilient means and the first piston, the presented end surfaces of said pistons being shaped so that a portion of said surface of the second piston is exposed to the pressure at the second end of the first cylinder, passage means interconnecting the ends of said first cylinder and second valve means operable when, in use, the pressure in said second end of the first cylinder is sufficient to cause separation of the presented surfaces of the pistons, to allow fuel to escape from said second end of the first cylinder.

2. An apparatus as claimed in claim 1, wherein the passage means comprises at least one passage extending through the first piston.

3. An apparatus as claimed in claim 2, wherein said at least one passage comprises a plurality of substantially straight, parallel passages.

4. An apparatus as claimed in claim 2, wherein said at least one passage comprises at least one helical passage.

5. An apparatus as claimed in claim 4, wherein the at least one helical passage is defined by at least one helical groove provided in the periphery of the first piston.

6. An apparatus as claimed in claim 1, wherein the passage means is arranged to permit a restricted flow of fluid between the first and second ends of the first cylinder.

7. An apparatus as claimed in claim 1, wherein the second valve means is defined by the engagement of an inclined surface of one of the pistons with the presented surface of the other of the pistons.

8. An apparatus as claimed in claim 1, wherein the second piston is provided with a passage permitting fluid to escape from the second end of the first cylinder upon separation of the pistons.

* * * * *